US011747045B2

(12) United States Patent
Haak et al.

(10) Patent No.: US 11,747,045 B2
(45) Date of Patent: Sep. 5, 2023

(54) PORTABLE INDIRECT FUEL FIRED HEATER WITH AUTOMATED COMBUSTION OPTIMIZATION

(71) Applicant: Frost Fighter Inc., Winnipeg (CA)

(72) Inventors: Ernest Haak, Winnipeg (CA); Darren Isaac, Winnipeg (CA)

(73) Assignee: Frost Fighter Inc., Manitoba (CA)

( * ) Notice: Subject to any disclaimer, the term of this patent is extended or adjusted under 35 U.S.C. 154(b) by 0 days.

(21) Appl. No.: 16/832,329

(22) Filed: Mar. 27, 2020

(65) Prior Publication Data

US 2020/0400345 A1 Dec. 24, 2020

Related U.S. Application Data

(60) Provisional application No. 62/864,796, filed on Jun. 21, 2019.

(51) Int. Cl.

| | |
|---|---|
| ***F24H 3/06*** | (2022.01) |
| ***F24H 9/00*** | (2022.01) |
| ***F24H 9/1881*** | (2022.01) |
| ***F24H 9/20*** | (2022.01) |
| ***F23N 5/00*** | (2006.01) |

(Continued)

(52) U.S. Cl.

CPC ..... *F24H 3/065* (2013.01); *F24H 9/0063* (2013.01); *F24H 9/0068* (2013.01); *F24H 9/1881* (2013.01); *F24H 9/2085* (2013.01)

(58) Field of Classification Search

CPC ..... F23N 5/006; F24H 3/0417; F24H 3/065; F24H 3/087; F24H 9/0063; F24H 9/0068; F24H 9/1881; F24H 9/2085

See application file for complete search history.

(56) References Cited

U.S. PATENT DOCUMENTS 2,980,334 A * 4/1961 Geniesse ..... F23N 5/006 236/14
3,111,978 A * 11/1963 Peoples ..... F24H 9/2085 110/162

(Continued)

FOREIGN PATENT DOCUMENTS

| | | | | |
|---|---|---|---|---|
| AT | 395211 B | * | 10/1992 | ..... F23N 3/002 |
| DE | 2908714 A1 | * | 9/1980 | ..... F23N 3/085 |
| JP | 61128024 A | * | 6/1986 | ..... F23N 5/006 |

*Primary Examiner* — Jorge A Pereiro

*Assistant Examiner* — Logan P Jones

(74) *Attorney, Agent, or Firm* — Ryan W. Dupuis; Kyle R. Satterthwaite; Ade & Company Inc.

(57) ABSTRACT

A portable indirect fuel fired heater includes a burner assembly having a fuel burner to deliver fuel from a fuel supply to a combustion chamber of the heater and a combustion air blower to deliver combustion air to the combustion chamber with the fuel for combustion in the combustion chamber to produce exhaust gases. A heat exchanger receives air to be heated in heat exchanging relationship with at least a portion of the combustion chamber. A sensor senses an oxygen level as a partial pressure of oxygen in the exhaust gases. A controller operates an actuator operatively connected to the burner assembly to controllably vary the delivery rate of combustion air and thus vary the ratio of the air and fuel responsive to the oxygen level sensed by the combustion sensor so as to maintain the sensed oxygen level at a prescribed set point level stored on the controller.

8 Claims, 3 Drawing Sheets

(51) Int. Cl.
*F24H 3/04* (2022.01)
*F24H 3/08* (2022.01)

(56) References Cited

U.S. PATENT DOCUMENTS 3,164,145 A * 1/1965 Tolson ..... F24H 3/025
126/110 R
3,364,917 A * 1/1968 Woollen, Jr. ..... F24H 3/0488
126/110 R
3,549,089 A * 12/1970 Hamlett ..... F23N 5/006
236/15 E
3,616,408 A * 10/1971 Hickam ..... G01N 27/407
204/410
4,508,501 A * 4/1985 Kuhn ..... F23N 5/006
126/91 A
5,330,719 A * 7/1994 Barnett ..... F23N 5/006
73/23.31
5,997,279 A * 12/1999 Hosome ..... F23N 5/006
431/76
2009/0025655 A1* 1/2009 Tanaka ..... B01D 53/8696
122/14.21
2011/0183600 A1* 7/2011 Chua ..... F24F 13/1413
454/358
2012/0116589 A1* 5/2012 Schneider ..... G05B 15/00
700/274
2012/0272945 A1* 11/2012 Froese ..... F24D 5/02
126/116 R
2016/0025380 A1* 1/2016 Karkow ..... F23N 5/006
122/14.22
2017/0038094 A1* 2/2017 Poehlman ..... F23L 3/00

* cited by examiner

PORTABLE INDIRECT FUEL FIRED HEATER WITH AUTOMATED COMBUSTION OPTIMIZATION

This application claims the benefit under 35 U.S.C. 119(e) of U.S. provisional application Ser. No. 62/864,796, filed Jun. 21, 2019.

FIELD OF THE INVENTION

The present invention relates to a portable indirect fuel fired heater, for example a construction heater, using an automated system for optimizing combustion, and more particularly the present invention relates to a portable indirect fuel fired heater in which the air to fuel ratio is varied to optimize the combustion system across a range of different environmental conditions.

BACKGROUND

Customers using portable construction heaters do so in every type of environmental conditions and these conditions are dynamic, often changing rapidly. Since a large percentage of the construction heater market is the rental industry, these heaters can be operating for a short time at locations near sea level and then be moved to locations at much higher altitudes. The ambient temperatures can change weekly and even daily from 0° C. to −40° C. The type and consistency of the fuel supplied to these heaters also changes due to geographic location and/or availability. The fuel supplied can range from #1 or #2 heating oil, to pump grade diesel fuel, to kerosene or to JP8 jet fuel. These fuels all have different densities and energy content, and the density of many of these will change with changes in ambient conditions which greatly affects the air/fuel ratio required.

Portable construction heaters are typically left on jobsites unattended for extended periods of time and then moved to another location. The geographical changes and temperature fluctuations will alter the firing conditions of the heater and the suppliers of this equipment cannot feasibly send personnel out continuously to monitor and adjust these heaters in order to ensure reliable and safe operation.

SUMMARY OF THE INVENTION

According to one aspect of the invention there is provided a portable indirect fuel fired heater for use with a fuel supply, the heater comprising:

a combustion chamber defining a combustion passage extending from a combustion inlet to a combustion outlet of the heater;

a burner assembly in communication with the combustion inlet of the combustion chamber, the burner assembly comprising (i) a fuel burner arranged to deliver fuel from the fuel supply to the combustion chamber at a prescribed fuel rate, and (ii) a combustion air blower arranged to deliver combustion air to the combustion chamber with the delivered fuel at a prescribed air rate for combusting the fuel in the combustion chamber to produce exhaust gases;

a heat exchanger defining a heating air passage extending therethrough from a heating inlet to the heating outlet of the heater for receiving air to be heated therethrough, the heat exchanger being in heat exchanging relationship with at least a portion of the combustion passage;

a combustion sensor in communication with the combustion passage so as to be arranged to sense an oxygen level in the exhaust gases that are produced by the combustion of the fuel in the combustion chamber;

an actuator operatively connected to the burner assembly so as to be arranged to controllably vary a ratio of the air and fuel delivered by the fuel burner and the combustion air blower respectively to the combustion chamber; and a controller operatively connected to the combustion sensor and the actuator, the controller being arranged to operate the actuator responsive to the oxygen level sensed by the combustion sensor so as to maintain the sensed oxygen level at a prescribed set point level stored on the controller.

The portable indirect fuel fired heater described herein includes a fully automatic ENV control system for portable indirect fired construction heaters that can adapt automatically to changes in air density due to variations in altitude, temperature and fuel type/density. These heating units are expected to operate at altitudes from sea level to 3000 m (10,000 ft.) and above and in ambient temperatures from −50° C. to +20° C.

Oxygen ($O_2$) sensing technology has been utilized to develop a fully automatic burner control system that is attached to approved commercial burners and that will automatically adjust the air/fuel ratio to compensate for all operating conditions. This system monitors the partial pressure of oxygen in the combustion gases present in a secondary heat exchanger portion of the combustion chamber and will continuously adjust the air/fuel ratio to compensate for air density changes, temperature changes and changes in the fuel type, density and BTU content. This system permits these portable construction heaters to operate reliably and consistently in all locations and ambient conditions and with all fuel types without the need for any supervision or modification by personnel.

Preferably the actuator is operatively connected to the combustion air blower so as to be arranged to controllably vary said ratio of the air and fuel by varying the prescribed air rate supplied by the combustion air blower. The heater in this instance may further include a damper member adjustably coupled to the combustion air blower so as to be arranged to provide a variable flow restriction to the combustion air blower, in which the actuator is coupled to the damper member to vary the prescribed air rate of the combustion air blower by adjusting a position of the damper member, and in which the damper member is supported in communication with an inlet of the combustion air blower.

The damper member may be supported within a respective duct so as to be movable between an open position defining a maximum cross sectional flow area through the duct and a closed position defining a minimum cross sectional flow area through the duct, in which the minimum cross sectional flow area defined by the damper member in the closed position corresponds to a minimum prescribed air rate for consistent starting up of the heater.

In the illustrated embodiment, the damper member is a damper plate which is pivotally supported within the duct so as to be oriented substantially perpendicularly to an axial direction of the duct in the open position thereof while being undersized relative to the duct such that a gap between a peripheral edge of the damper plate and walls of the duct define the minimum cross sectional flow through the duct in the open position.

Preferably, the oxygen level sensed by the combustion sensor comprises a partial pressure of oxygen within the exhaust gases.

The combustion sensor may further include a pump arranged to draw a sample from the exhaust gases in which combustion sensor is arranged to sense an oxygen pressure level within the sample.

The heater may further include a flow restriction in the combustion passage between the combustion sensor and the combustion outlet of the heater.

In the illustrated embodiment, the combustion chamber comprises a multi-chamber combustion chamber including a primary portion at the combustion inlet in communication with the burner assembly and a secondary portion partitioned from the primary portion between the primary portion and the combustion outlet. In this instance, the combustion sensor is preferably located in the secondary portion in proximity to the combustion outlet.

The fuel burner may be operable in a first mode arranged to deliver the fuel at a first fuel rate and in a second mode arranged to deliver the fuel at a second fuel rate which is greater than the first fuel rate. In this instance, in each mode the actuator remains operatively connected to the combustion air blower so as to be arranged to controllably vary said ratio of the air and fuel by varying the prescribed air rate of the combustion air blower so as to maintain the sensed oxygen level within a prescribed set point level stored on the controller.

The heater may include an operator input operatively connected to the fuel burner and arranged to receive a manual input from a user to vary the fuel burner between the first mode and the second mode. Alternatively to the operator input, or in addition thereto, the heater may include a temperature sensor arranged to sense an ambient temperature and/or outlet air temperature such that the controller is operatively connected to the fuel burner so as to be arranged to vary the fuel burner between the first mode and the second mode responsive to the temperature sensed by the temperature sensor(s).

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
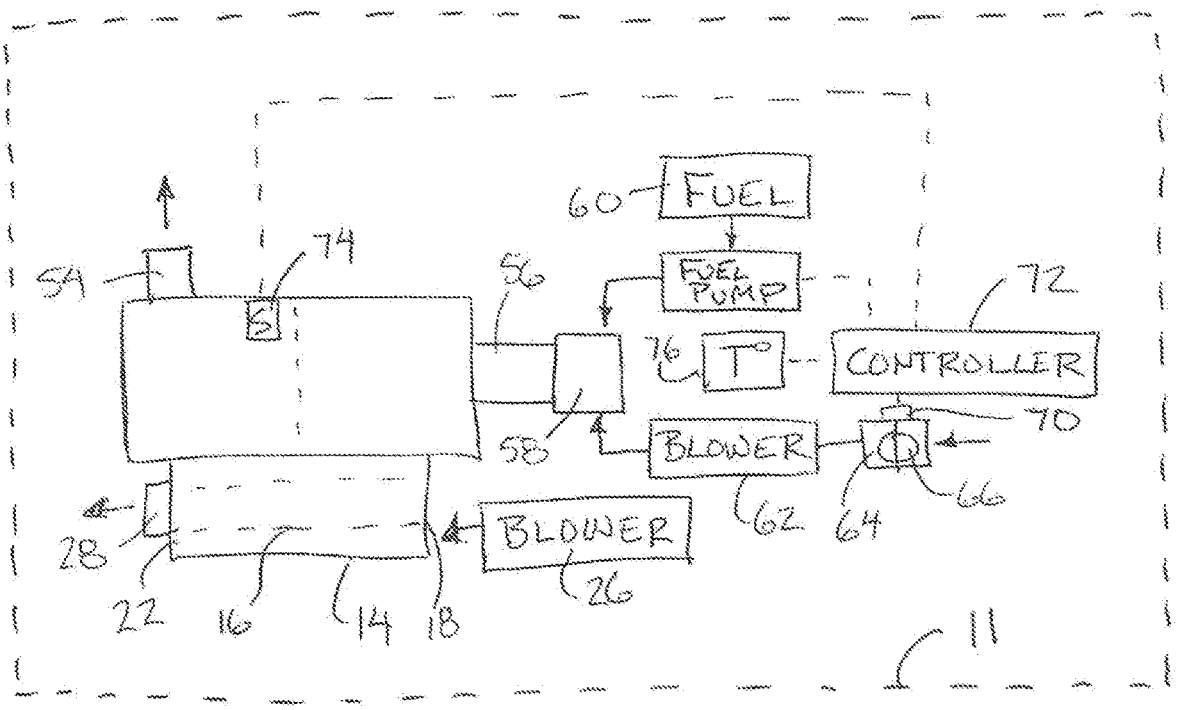
FIG. 1 is a schematic representation of the fuel fired heater according to the present invention.

Referring to the accompanying figures there is illustrated a fuel fired heater 10, for example an indirect fuel fired construction heater which combusts fuel, such as a heating oil and heats air passed through a separate air passage of a heat exchanger of the heater.

The heater 10 typically comprises a base frame 11, for example a cart typically having a combination of legs and/or wheels to support the heater on a suitable supporting surface in a portable manner. The heater 10 includes an insulated main housing 12 which defines an exterior shell of the heater and which forms an exterior boundary of a heat exchanger 14 defining an air passage 16 therethrough from a heating inlet 18 at an inlet and 20 of the heater to a heating outlet 22 at an outlet and 24 of the heater. A heating air blower 26 is mounted at the inlet end of the housing for drawing air from the surrounding environment and supplying the air as heating air into the heater inlet 18 of the heat exchanger. An outlet collar 28 is mounted at the outlet end of the housing to define a discharge opening therein which forms the heating outlet 22 of the air passage of the heat exchanger.

The heater 10 further includes a combustion chamber within the housing which defines a combustion passage extending through the housing in heat exchanging relationship with the air passage of the heat exchanger from a combustion inlet 30 at the inlet end of the housing to a combustion outlet 32 at the outlet end of the housing. More particularly the combustion chamber comprises a primary combustion portion 34 in the form of a cylindrical shell concentrically mounted within the housing such that an axis of the cylindrical vessel is oriented in a longitudinal direction of the heater from the inlet end to the outlet end thereof. The primary combustion portion 34 communicates with the combustion inlet at a central location at the inlet end thereof. Fuel and air for combustion are directed into the primary combustion chamber in an axial direction from the combustion inlet 30.

The resultant mixture of fuel and combustion air undergoes at least partial combustion as it is circulated back from the outlet end toward the inlet end along the periphery of the primary combustion portion 34. The partially combusted mixture exits the primary combustion portion at a plurality of intermediate outlets 36 connected between the bottom of the primary combustion portion 34 in proximity to the inlet end thereof to a secondary heat transfer portion 38 of the combustion chamber within the housing.

The secondary heat transfer portion 38 is an annular vessel having an inner cylindrical wall 40 and an outer cylindrical wall 42 mounted concentrically with one another and concentrically with the primary combustion portion 34 received therein and the exterior shell of the main housing 12 defining the heat exchanger about the secondary heat transfer portion 38. The inner and outer walls 40 and 42 are radially spaced apart so that the radial gap between the walls forms the secondary heat transfer portion of the combustion chamber. The inner and outer cylindrical walls are enclosed at opposing ends thereof similarly to the primary combustion portion 34 which is enclosed at axially opposing ends of the cylindrical shell thereof.

The concentric mounting of the secondary heat transfer portion 38 about the primary combustion portion 34 defines a first annular gap 44 therebetween, while the concentric mounting of the secondary heat transfer portion 38 within the surrounding main housing 12 of the heater defines a second annular gap 46 therebetween. The first and second annular gaps are in open communication with one another at axially opposing ends of the heater due to the main housing 12 protruding longitudinally outwardly beyond the primary combustion portion and the secondary heat transfer portion of the combustion chamber at both ends of the heater.

The resulting axial space between the end of the main housing 12 and the end of the combustion chamber portions at the inlet end defines an inlet manifold 48 of the air passage 16 of the heat exchanger which is in communication with the heating air blower 26 to receive the supply of heating air through the passage. Similarly, the axial space between the end of the main housing and the end of the combustion chamber portions at the outlet end of the heater defines an outlet manifold which allows both the first and second annular gaps 44 and 46 of the air passage 16 to communicate with the outlet collar 28.

A plurality of radially extending intermediate tubes 50 communicate from the intermediate outlets of the primary combustion portion 34 to the inlet end of the secondary heat transfer portion 38 adjacent the bottom end thereof so as to span across the first annular gap 34. The radial tubes 50 allow communication of partially or fully combusted fuel and air to be communicated from the primary combustion portion 34 to the secondary heat transfer portion 38 without communication or mixing with the air in the air passage 16 of the heat exchanger.

Figure 2:
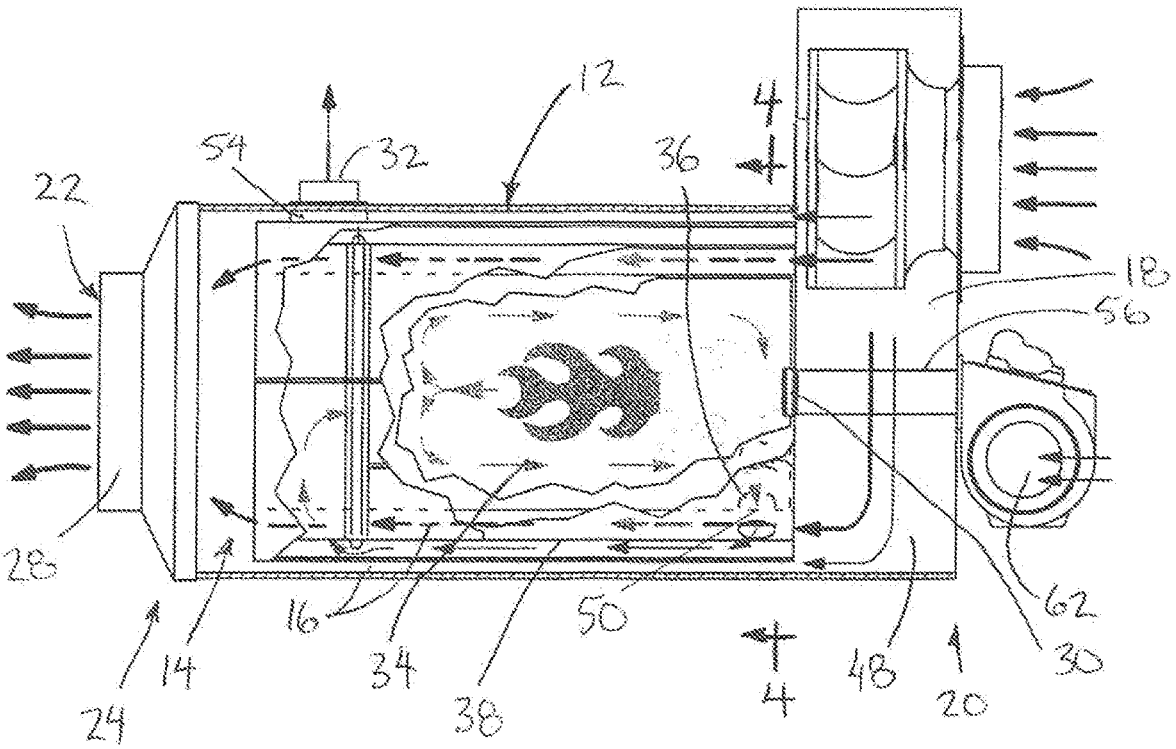
FIG. 2 is a partly sectional side elevational view of the heater according to FIG. 1 illustrating the relationship between a primary combustion portion and a secondary heat transfer portion of the combustion chamber.
Figure 3:
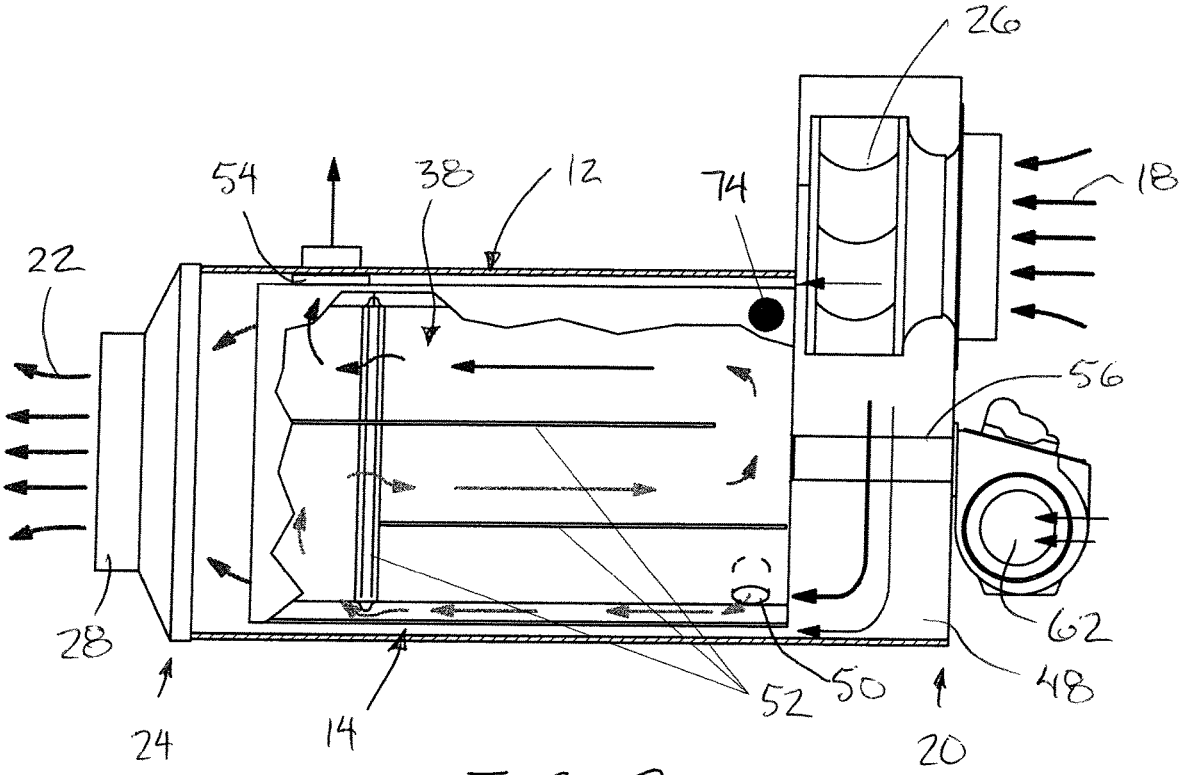
FIG. 3 is another partly sectional side elevational view of the heater according to FIG. 1 illustrating the configuration and combustion gas flow pattern through the baffles of the secondary heat transfer portion of the combustion chamber.
Figure 4:
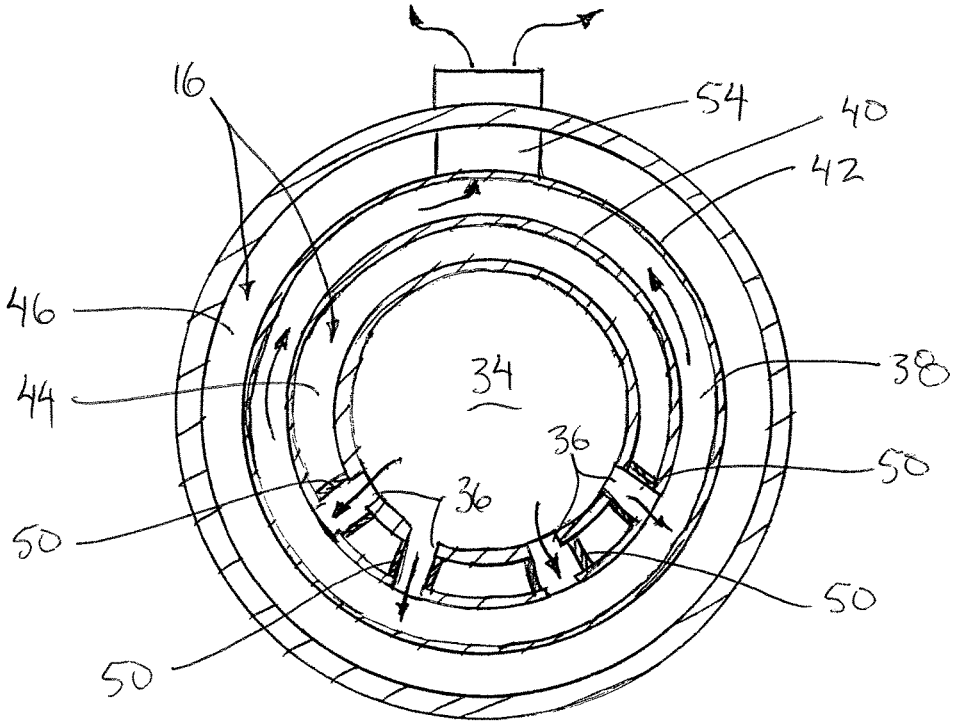
FIG. 4 is a sectional view along the line 4-4 in FIG. 2 illustrating an end view of the primary combustion portion and the secondary heat transfer portion of the combustion chamber relative to the heating air passage of the heat exchanger.
Figure 5:
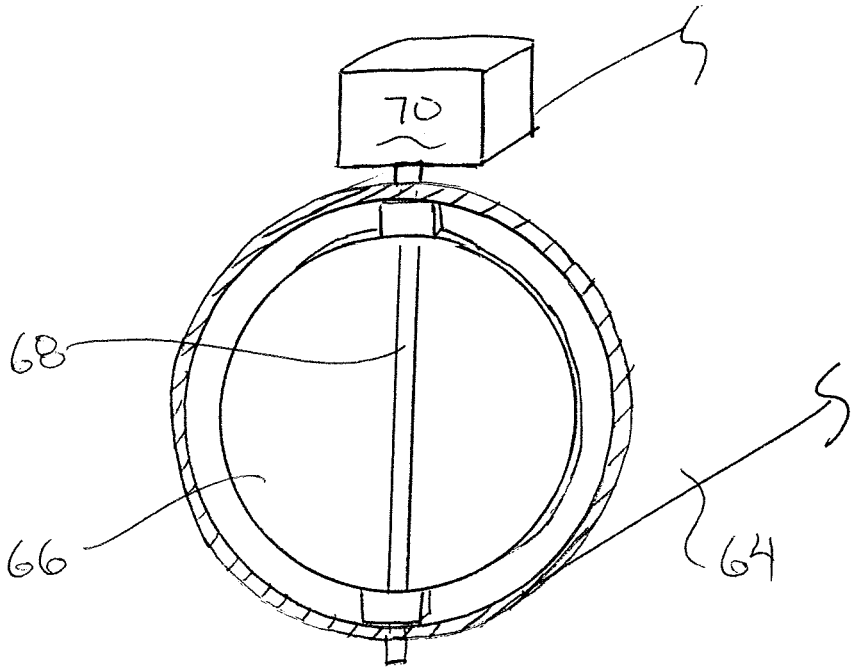
FIG. 5 is a perspective view of the damper member at the inlet end of the combustion blower.
Figure 6:
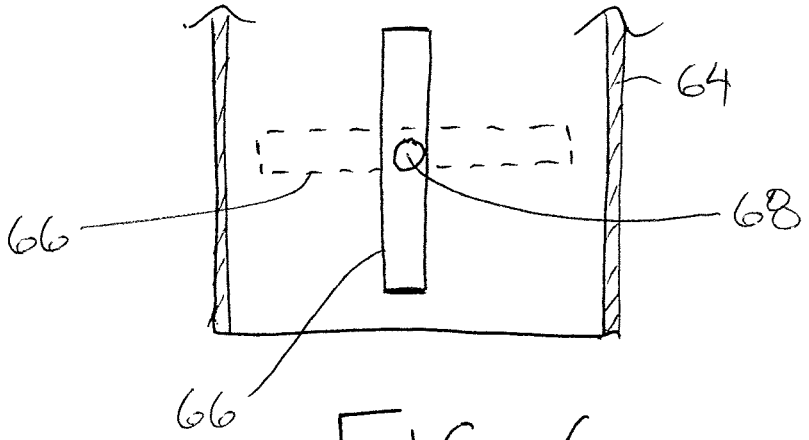
FIG. 6 is a top plan view of the damper member shown in the open position relative to the duct in solid line and shown in the closed position relative to the duct in broken line.

A series of baffles 52 are provided within the secondary heat transfer portion of the combustion chamber such that exhaust gases within the secondary heat transfer portion 38 follow a sinuous path between the inlet and outlet ends thereof as the gases pass from the intermediate tubes 50 at the bottom to an exhaust tube 54 in communication with the top end of the secondary heat transfer chamber. More particularly the exhaust tube 54 communicates radially across the second annular gap 46 between the top end of the secondary heat transfer portion of the combustion chamber and the upper boundary of the housing defining the heat exchanger at the outlet end of the heater. The exhaust tube is reduced in cross-sectional flow area relative to the lower area along the final leg of the sinuous path through the secondary heat transfer portion of the combustion chamber and includes a final restriction radially around the exterior surface of the secondary heat transfer portion immediately prior to the gasses passing into this exhaust tube such that it and the exhaust tube acts as a flow restriction at the combustion outlet 32 of the combustion passage. In this manner, exhaust gases from the combustion of the fuel and the air are circulated along at least one primary longitudinal pass through the combustion chamber between the second end of the heater and the first end of the heater as shown by the flow arrows in FIG. 2, followed by being directed by the baffles 32 through a plurality of secondary longitudinal passes extending longitudinally between the first end and the second end of the heater before reaching the combustion outlet at the second end of the heater as shown by the flow arrows in FIG. 3. The combustion sensor 74 is shown in FIG. 3 as being situated at the first end of the heater in communication with the secondary combustion portion downstream from two of the secondary longitudinal passes.

A burner assembly is supported at the inlet end of the heater to supply fuel and combustion air into the inlet end of the primary combustion portion of the combustion chamber. The burner assembly includes a burner tube 56 spanning the axial gap between the inlet end of the main housing 12 and the inlet end of the primary combustion chamber so as to span across the inlet manifold area 48 of the air passage 16. A fuel burner assembly 58 is supported within the burner tube 56 and includes a fuel nozzle, a specified air cone mixing head and ignitor rods. The fuel burner includes a fuel pump to receive liquid fuel from a suitable fuel supply 60 and deliver the fuel at a prescribed fuel rate to a suitable nozzle or injector that delivers the liquid fuel into the burner tube in atomized manner. The fuel burner 58 further includes a combustion air blower 62 which draws air in at a blower inlet 64 from the surrounding environment and delivers the combustion air for mixing with the fuel in the burner tube 56. The blower delivers combustion air at a prescribed air rate which is selected such that the ratio of fuel and combustion air is suitable for combustion. This ratio is adjusted by adjusting the prescribed air delivery rate of the combustion blower so that the ratio of fuel and combustion air is suitable for combustion across a wide range of environmental conditions as described in the following.

The blower inlet 64 includes an inlet duct which supports an adjustable damper member 66 therein. As the position of the damper member 66 is adjusted, the cross-sectional flow area through the inlet duct is varied which will vary the prescribed air delivery rate of the combustion blower even if the operating signal for driving the blower remains constant. The damper member is a circular plate having a pivot shaft 68 mounted to extend diametrically across the plate. The pivot shaft 68 is supported by suitable bearings at diametrically opposing sides of the inlet duct 64 within which the plate is mounted. The plate is pivotal between a closed position oriented generally perpendicularly to the longitudinal axis of the inlet duct so as to define a minimum cross-sectional flow area through the inlet duct and thus a minimum prescribed combustion air rate of the blower, and an open position oriented generally parallel to the duct axis so as to define a maximum cross-sectional flow area through the inlet duct and thus a maximum prescribed combustion air rate of the blower. The plate forming the damper member 66 is circular so as to be similar in cross-sectional shape to the inlet duct but is undersized in diameter relative to the interior diameter of the round inlet duct so as to define an annular gap between the periphery of the damper member and the surrounding walls of the inlet duct in the closed position such that the annular gap defines the minimum cross-sectional flow area.

The adjustable damper member is typically located in the closed position at start up, resulting in the richest or maximum fuel to air ratio required, however, once combustion occurs the available oxygen within the combustion chamber immediately drops below the pre-set lower limit, and therefore the position of the damper is adjusted continuously in real time to achieve a fuel to air ratio which is more suitable for optimum combustion during continued operation of the heater.

The damper member is adjusted by arranging the pivot shaft 68 to protrude outwardly through the wall of the inlet duct 66 to the exterior of the inlet duct where the pivot shaft is coupled to an actuator motor 70 supported externally on the inlet duct. The actuator motor is able to angularly position the pivot shaft, and thus the damper member supported thereon at any desired setting between the open and closed positions of the damper member.

A controller 72 is supported on the heater for operating the actuator motor 70 by generating suitable analog output signals that are received by the actuator motor for repositioning the damper member in a desired manner. The controller 72 is a printed circuit board including a microprocessor and a computer memory incorporated therein for storing programming instructions and executing the programming instructions to provide programmable control of the operation of the actuator motor 70. The controller 72 also communicates with a combustion sensor 74 that monitors one or more characteristics of the exhaust gases. In response to a signal from the combustion sensor 74, the controller generates appropriate analog control signals communicated to the actuator motor 70 to reposition the damper member 66 to achieve optimum combustion.

The combustion sensor 74 comprises an oxygen sensor capable of sensing a partial pressure of oxygen within the exhaust gases. The combustion sensor 74 is located within the secondary heat transfer portion of the combustion chamber so as to be nearer to the outlet opening than the inlet opening of the combustion passage through the secondary heat transfer portion. Specifically, the combustion sensor in the illustrated embodiment is mounted at the inlet end of the heater at the top side of the secondary heat transfer chamber after the exhaust gases have already passed through a majority of the baffled passages within the secondary heat transfer portion. The flow restriction of the baffles of the combustion passage are thus located downstream from the combustion sensor such that the exhaust gases are at a suitably reduced temperature for sensing by the combustion sensor. The combustion sensor further includes a sampling pump incorporated therein which draws a sample flow out of the combustion chamber and through a sampling chamber of the sensor in a continuous flow. The sensor also includes an integral electric heater therein to ensure that the sensor operates at an appropriate temperature for the sensing element to dissociate producing mobile oxygen ions and therefore become a solid electrolyte for oxygen.

The combustion sensor 74 produces a signal representative of the partial pressure of oxygen within the sample which is received by the controller for comparison to a set point ambient oxygen level and target value stored on the controller. The setpoint level may comprise a single value or a range of values to be targeted for optimize combustion. These values are typically within a range of 1 and 14% partial pressure of oxygen. If the sensed value is above or below the set point oxygen level, the controller generates appropriate output signals to reposition the damper member in the appropriate direction to return the sensed value to the setpoint level. More particularly the sensed value may be an average amount of numerous sensed values over a prescribed time interval with the position of the damper member being repositioned in small increments at each sampling cycle which may be in the order of a few seconds or in the order of fractions of a second for example.

The fuel pump may be operated at a fixed rate for all environments, or alternatively may be operable at two or more different fuel delivery rates within a range of fuel rates. For example, the fuel pump may be operable by an independent controller in a first mode corresponding to a first fuel delivery rate or in a second mode at a second fuel delivery rate which is greater than the first fuel delivery rate. The fuel pump controller determines which mode the fuel pump should be operated in and sends appropriate signals to the fuel pump to operate the fuel pump in the appropriate mode. In either mode, a setpoint oxygen level remains stored on the combustion controller for using the oxygen level sensed by the combustion sensor 74 as an input to controllably vary the combustion air rate delivered by the combustion blower.

Operation of the fuel pump in either the first mode or the second mode can be accomplished using a manual input on a dedicated controller or on the fuel pump in one embodiment. In a further embodiment, the fuel pump may be automatically operated between the first mode and the second mode, or a plurality of additional modes corresponding to additional fuel delivery rates responsive to a sensed temperature input into the fuel pump controller from a temperature sensor 76. The temperature sensor 76 can be mounted externally on the heater or at the inlet of either the combustion air blower or the heating air blower for measuring ambient temperature of the air or can be mounted into the heated discharge air stream to measure the outlet air temperature. In this instance, depending upon the ambient temperature and thus the heating demands, different fuel delivery rates may be used. In a preferred arrangement, the temperature sensor 76 may be provided at the heating air outlet 22 to monitor the heated temperature of the air exiting from the heat exchanger. Again, the fuel pump controller will automatically select increasing fuel delivery rates in response to increased heating demands or automatically select decreasing fuel delivery rates in response to decreasing heating demands.

Typically, at initial startup of the heater, as there is no combustion taking place, the partial pressure of oxygen sensed by the combustion sensor will be very high such that the controller will initially fully close the damper member to achieve a maximum fuel to air ratio based upon the minimum airflow through the inlet duct which is determined to be suitable for start up. Within the initial few seconds of operation after combustion has occurred the partial pressure level of oxygen sensed by the combustion sensor will be reduced. As the sensed oxygen pressure level falls below a threshold range relative to the setpoint level stored on the controller, the damper member will begin to be displaced towards the open position in small increments at each sampling cycle and continue to open in increments until the sensed level is within threshold range of the setpoint level. If the sensed oxygen pressure level increases above an upper threshold range above the setpoint level, the reverse occurs and appropriate signals are generated by the controller to begin closing the damper member towards the closed position in increments at each sampling cycle until the sensed oxygen pressure level returns to being within the upper threshold range of the setpoint level. Operation continues in this manner with corrective signals to reposition the damper member being generated each time the sensed oxygen pressure level falls outside of the upper or lower threshold ranges from the setpoint level. If the heater is operated in different environmental conditions such as high altitude conditions or extreme high and low temperature environments, the controller continues to maintain the sensed oxygen pressure level at the stored setpoint level to achieve optimal combustion through a large range of environmental conditions.

As described herein, the burner air supply is continually adjusted with the ENV system with a pre-calculated maximum air/fuel ratio prior to firing based on relative ambient conditions. The burner head fires into the end of the primary heat exchanger which is basically just an unrestricted cylindrical chamber. The pressure created by the burner's air supply forces the heated gases to reverse direction toward the four bottom mounted crossover tubes. These tubes are connected into the secondary heat transfer portion which is a narrow cylinder with several baffles placed longitudinally along the inside length with a section taken out of the end. The gases that are flowing from the crossover tubes hit this first baffle and are directed to the front of this secondary chamber where the short opening in the baffle exists. The gas passes through this opening and encounter another baffle which has a short open section at the opposite end. The gases are forced to travel the length of that baffle toward this open section, pass through this open section and this is where the probe is mounted. A small sample of gases is continually drawn into the probe's porous head with a built-in pump and the probe is internally electrically heated to ensure proper reaction with the Zirconium element. The gases continue toward the front of the secondary heat transfer chamber toward the exhaust outlet and encounter one final radial baffle that narrows the path for a final retention effect before the gases are discharged.

Testing and experimentation over many years determined that the oxygen levels remaining in the flue gas can only be optimized to a specific minimum level. Attempting to drop below these levels causes other harmful gas levels to increase such as Carbon Monoxide (CO) and the combustion process begins to become unstable and unreliable. Maximum CO is also regulated to meet our national approval standards measured as a ratio of total combustion products in the flue gas. The use of various qualities of fuel and at different temperature densities is typical of the industry and conditions where this equipment is used which had to be considered. This experimentation and testing determined that an optimum oxygen level corresponding to a partial pressure of between 1% and 14% remaining in the flue gas was ideal for reliable and consistent burner operation and this was the set point used for our optimizer system.

The optimizer system consists of a specific Zirconium oxygen sensor and specifically is a probe type 5 wire sensor with a porous end cap and integrated heater and intake pump. This sensor unit is wired to a specific control board supplied by the same manufacturer and is configured for the $O_2$ set point. This control board is supplied the required power for it and the Zirconium $O_2$ sensor by a regulated 24 VDC power supply. The control is configured to the base line of 20.8% $O_2$ in the atmosphere and is set for a sensing data rate such that it avoids unnecessary hunting of the air intake damper. The control board converts the data it receives from the Zirconium $O_2$ sensor into a 0 to 10 VDC proportional output signal corresponding to the data that is fed to a 24 VDC motorized damper control module which responds as required to this signal. This damper control module is attached to the shaft of our in house designed plenum and damper that is attached to the Beckett fuel oil burners that are used on this line of heaters. The damper plate(s) have been calculated to provide the correct fuel/air ratio for ignition ($O_2$ is at 20.8% prior to ignition with the appropriate allowance for temperature/altitude air density) and immediately after ignition the $O_2$ in the combustion chamber will reduce, causing the damper to open and modulate in order to maintain the set point level of $O_2$.

The plenum assembly design incorporates a precision ground 303 stainless shaft supported between two precision bronze oil embedded flanged bushings with two damper plates sandwiched over the shaft with bolts allowing for quick removal or replacement if required.

This system has also allowed the option of two-level combustion if desired with two different firing ranges. These firing ranges could be specified as a manually controlled change or can automatically change based on temperature demand. The ENV control system will automatically adjust the fuel/air ratio for these two different firing ranges and will do this in all of the above environmental and geographical variations.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A portable indirect liquid fuel fired heater for use with a liquid fuel supply, the heater comprising:

a combustion chamber defining a combustion passage extending from a combustion inlet to a combustion outlet of the heater;

a burner assembly in communication with the combustion inlet of the combustion chamber, the burner assembly comprising (i) a liquid fuel burner arranged to deliver liquid fuel from the liquid fuel supply in an atomized manner to the combustion chamber at a prescribed fuel rate, and (ii) a combustion air blower arranged to deliver combustion air to the combustion chamber with the delivered fuel at a prescribed air rate for combusting the fuel in the combustion chamber to produce exhaust gases;

a heat exchanger defining a heating air passage extending though the heat exchanger from a heating inlet to a heating outlet of the heating air passage for receiving air to be heated through the heating air passage, the heating inlet and the heating outlet of the heating air passage being separate from the combustion inlet and the combustion outlet of the combustion passage, the heat exchanger passage being in heat exchanging relationship with at least a portion of the combustion passage;

a heating air blower supplying a flow of heating air through the heating air passage;

the combustion chamber, the burner assembly, the heat exchanger and the heating air blower being commonly supported on a base frame so as to be arranged to be portable together with the base frame;

a combustion sensor in communication with the combustion passage so as to be arranged to sense an oxygen level in the exhaust gases that are produced by the combustion of the fuel in the combustion chamber, the oxygen level sensed by the combustion sensor comprising a partial pressure of oxygen within the exhaust gases;

a damper member in adjustable communication with an inlet of the combustion air blower so as to be arranged to provide a variable flow restriction to the combustion air blower, the damper member being supported within a respective duct so as to be movable through a range of positions between an open position defining a maximum cross sectional flow area through the duct and a closed position defining a minimum cross sectional flow area through the duct;

an actuator operatively connected to the damper member so as to be arranged to controllably vary a ratio of the air and the fuel delivered by the combustion air blower and the fuel burner respectively to the combustion chamber by adjusting a position of the damper member so as to vary the prescribed air rate of the combustion air blower; and a controller operatively connected to the combustion sensor and the actuator, the controller being arranged to operate the actuator responsive to the oxygen level sensed by the combustion sensor;

the controller, prior to ignition of the burner, being arranged to operate the actuator to displace the damper member responsive to the oxygen level sensed by the combustion sensor to position the damper member to achieve a prescribed startup fuel to air ratio based on the prescribed fuel rate and the position of the damper member, said prescribed startup fuel to air ratio being suitable for achieving ignition of the burner; and the controller, subsequent to ignition of the burner, being arranged to operate the actuator to displace the damper responsive to the oxygen level sensed by the combustion sensor to position the damper member to achieve a prescribed combustion fuel to air ratio based on the prescribed fuel rate and the position of the damper, said prescribed combustion fuel to air ratio being suitable for optimal combustion by the burner subsequent to ignition of the burner.

2. The heater according to claim 1 wherein the damper member comprises a damper plate which is pivotally supported within the duct, the damper plate being oriented substantially perpendicularly to an axial direction of the duct in the closed position thereof and the damper plate being undersized relative to the duct such that a gap between a peripheral edge of the damper plate and walls of the duct define the minimum cross sectional flow through the duct in the closed position.

3. The heater according to claim 1 wherein the combustion sensor includes a pump arranged to draw a sample from the exhaust gases in which combustion sensor is arranged to sense an oxygen level within the sample.

4. The heater according to claim 1 further comprising a flow restriction in the combustion passage between the combustion sensor and the combustion outlet of the heater.

5. The heater according to claim 1 wherein the combustion chamber comprises a multi-chamber combustion chamber including a primary chamber portion at the combustion inlet in communication with the burner assembly and a secondary chamber portion between the primary chamber portion and the combustion outlet, the secondary chamber portion being partitioned from the primary chamber portion by a portion of the heating air passage received between the primary chamber portion and the secondary chamber portion, the combustion sensor being located in the secondary chamber portion in proximity to the combustion outlet.

6. The heater according to claim 1 wherein the combustion chamber is a multi-chamber combustion chamber including a primary chamber portion at the combustion inlet in communication with the burner assembly and a secondary chamber portion downstream from the primary chamber portion between the primary chamber portion and the combustion outlet, the secondary chamber portion including a plurality of baffles therein defining a sinuous path through which exhaust is directed, the combustion sensor being located in the secondary chamber portion after the exhaust gases have already passed through a majority of the sinuous path defined by the baffles.

7. A portable indirect liquid fuel fired heater for use with a liquid fuel supply, the heater comprising:

a combustion chamber defining a combustion passage extending from a combustion inlet at a first end of the heater to a combustion outlet at a second end of the heater;

a burner assembly at the first end of the heater in communication with the combustion inlet of the combustion chamber, the burner assembly comprising (i) a liquid fuel burner arranged to deliver liquid fuel from the liquid fuel supply in an atomized manner to the combustion chamber at a fixed fuel rate, and (ii) a combustion air blower arranged to deliver combustion air to the combustion chamber with the delivered fuel at a prescribed air rate for combusting the fuel in the combustion chamber to produce exhaust gases;

a heat exchanger defining a heating air passage extending therethrough from a heating inlet to a heating outlet of the heater for receiving air to be heated therethrough, the heating inlet and the heating outlet of the heating air passage being separate from the combustion inlet and the combustion outlet of the combustion passage, the heat exchanger being in heat exchanging relationship with at least a portion of the combustion passage;

a heating air blower supplying a flow of heating air through the heating air passage;

the combustion chamber, the burner assembly, the heat exchanger and the heating air blower being commonly supported on a base frame so as to be arranged to be portable together with the base frame;

a combustion sensor in communication with the combustion passage so as to be arranged to sense an oxygen level in the exhaust gases that are produced by the combustion of the fuel in the combustion chamber;

the combustion sensor being located downstream from a majority of the heat exchanging relationship between the combustion passage and the heating air passage;

a damper member in adjustable communication with an inlet of the combustion air blower so as to be arranged to provide a variable flow restriction to the combustion air blower;

an actuator operatively connected to the damper member so as to be arranged to controllably vary a ratio of the air and fuel delivered by the fuel burner and the combustion air blower respectively to the combustion chamber by adjusting a position of the damper member so as to vary the prescribed air rate of the combustion air blower; and a controller operatively connected to the combustion sensor and the actuator, the controller being arranged to operate the actuator responsive to the oxygen level sensed by the combustion sensor so as to maintain the sensed oxygen level at a prescribed set point level stored on the controller;

the combustion chamber comprising:

(i) a primary combustion portion extending in a longitudinal direction from the combustion inlet at the first end of the heater to the second end of the heater in which the primary combustion portion receives the fuel from the fuel burner and the combustion air from the combustion air blower so as to be at least partially combusted in the primary combustion portion such that the exhaust gases are circulated along at least one primary longitudinal pass through the combustion chamber from the second end of the heater and to the first end of the heater; and (ii) a secondary combustion portion receiving the exhaust gases from an intermediate outlet of the primary combustion portion in which the secondary combustion portion includes one or more baffles defining a sinuous path including three secondary longitudinal passes each extending longitudinally between the first end and the second end of the heater and arranged to direct the exhaust gases therethrough before reaching the combustion outlet at the second end of the heater;

(iii) wherein the primary combustion portion and the secondary combustion portion separated by a portion of the heating air passage between the primary combustion portion and the secondary combustion portion; and (iv) wherein the primary combustion portion and the secondary combustion portion communicate with one another in proximity to the first end of the heater;

the combustion sensor being situated at the first end of the heater in communication with the secondary combustion portion downstream from two of the secondary longitudinal passes within the secondary combustion chamber whereby the exhaust gases must be communicated along said at least one primary longitudinal pass of the primary combustion chamber from the second end of the heater to the first end of the heater and along two of the secondary longitudinal passes of the sinuous path of the secondary combustion chamber from the first end of the heater to the second end of the heater and subsequently from the second end of the heater to the first end of the heater prior to communication of the exhaust gases with the combustion sensor.

8. The heater according to claim 2 wherein the combustion sensor includes an integral electric heater therein arranged to operate a sensing element of the combustion sensor at a prescribed temperature.

* * * * *